US009512749B2

(12) United States Patent
Pierik

(10) Patent No.: US 9,512,749 B2
(45) Date of Patent: Dec. 6, 2016

(54) SYSTEM AND METHOD FOR CALIBRATING A VALVE LIFT SENSOR AND EVALUATING A VALVE LIFT SENSOR AND A HYDRAULIC VALVE ACTUATOR

(75) Inventor: Ronald J. Pierik, Holly, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1021 days.

(21) Appl. No.: 13/488,948

(22) Filed: Jun. 5, 2012

(65) Prior Publication Data

US 2013/0325290 A1 Dec. 5, 2013

(51) Int. Cl.

| | |
|---|---|
| ***F01L 1/18*** | (2006.01) |
| ***F01L 3/24*** | (2006.01) |
| ***F01L 9/02*** | (2006.01) |
| ***F02D 13/00*** | (2006.01) |

(52) U.S. Cl.

CPC .. *F01L 3/24* (2013.01); *F01L 9/02* (2013.01); *F02D 13/00* (2013.01); *F01L 2009/028* (2013.01); *F01L 2800/11* (2013.01); *F01L 2800/14* (2013.01); *F01L 2820/045* (2013.01)

(58) Field of Classification Search

CPC ..... F01L 9/02; F01L 2800/00; F01L 3/24; F01L 2800/11; F01L 2009/028; F01L 2820/045; F01L 2800/14; Y02T 10/18; F02D 13/0207; F02D 13/0226; F02D 13/00

USPC ..... 701/102–105; 123/90.1–90.15, 90.23, 123/90.45, 90.46, 90.52, 90.55; 73/114.77, 73/114.79

See application file for complete search history.

(56) References Cited

U.S. PATENT DOCUMENTS

| | | | | |
|---|---|---|---|---|
| 6,178,934 | B1 * | 1/2001 | Hirasawa | F01L 9/04 123/90.11 |
| 6,619,245 | B1 * | 9/2003 | Fujiwara | F01L 9/04 123/90.11 |
| 7,546,827 | B1 * | 6/2009 | Wade et al. | 123/324 |
| 8,181,508 | B2 | 5/2012 | Cinpinski et al. | |
| 2002/0066435 | A1 * | 6/2002 | Okamoto | F02D 11/107 123/396 |
| 2002/0121267 | A1 * | 9/2002 | Denz | F01L 1/00 123/435 |
| 2005/0044934 | A1 * | 3/2005 | Weiss | F01L 1/46 73/114.79 |
| 2005/0165536 | A1 * | 7/2005 | Fukasawa | F02D 35/027 701/111 |
| 2005/0229883 | A1 * | 10/2005 | Arai | F02D 13/0226 123/90.16 |
| 2007/0012268 | A1 * | 1/2007 | Nakamura | F01L 9/04 123/90.11 |
| 2009/0014672 | A1 * | 1/2009 | Schiemann | F01L 9/02 251/129.01 |
| 2009/0206288 | A2 * | 8/2009 | Schiemann | 251/129.01 |
| 2009/0222196 | A1 * | 9/2009 | Cinpinski | F01L 1/34 701/105 |
| 2010/0263611 | A1 * | 10/2010 | Kenchington | F01L 9/02 123/90.12 |
| 2010/0281966 | A1 * | 11/2010 | Cinpinski et al. | 73/114.25 |
| 2010/0294239 | A1 * | 11/2010 | Mc Lain | F02D 41/0002 123/344 |
| 2011/0056448 | A1 | 3/2011 | Cinpinski et al. | |
| 2011/0153181 | A1 * | 6/2011 | Bagnasco | F01L 13/00 701/109 |

FOREIGN PATENT DOCUMENTS

CN 102022207 A 4/2011

* cited by examiner

*Primary Examiner* — Joseph Dallo

(57) ABSTRACT

A system according to the principles of the present disclosure includes a valve control module and a fault detection module. The valve control module controls a valve actuator to actuate a valve of an engine from a first lift position to a second lift position that is different from the first lift position. The valve includes at least one of an intake valve and an exhaust valve. The fault detection module detects a fault in at least one of a valve lift sensor and the valve actuator based on input received from the valve lift sensor when the valve is adjusted to the first lift position and when the valve is adjusted to the second lift position.

22 Claims, 5 Drawing Sheets

SYSTEM AND METHOD FOR CALIBRATING A VALVE LIFT SENSOR AND EVALUATING A VALVE LIFT SENSOR AND A HYDRAULIC VALVE ACTUATOR

FIELD

The present disclosure relates to systems and methods for calibrating a valve lift sensor and evaluating a valve lift sensor and a hydraulic valve actuator.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel mixture within cylinders to drive pistons, which produces drive torque. Air enters the cylinders through intake valves. Fuel may be mixed with the air before or after the air enters the cylinders. In spark-ignition engines, spark initiates combustion of the air/fuel mixture in the cylinders. In compression-ignition engines, compression in the cylinders combusts the air/fuel mixture in the cylinders. Exhaust exits the cylinders through exhaust valves.

A valve actuator actuates the intake and exhaust valves. The valve actuator may be driven by a camshaft. For example, the valve actuator may be a hydraulic lifter that is coupled to the camshaft using a pushrod or directly coupled to the camshaft. Alternatively, the valve actuator may actuate the intake and exhaust valves independent from a camshaft. For example, the valve actuator may be hydraulic, pneumatic, or electromechanical, and may be included in a camless engine or a camless valve train.

SUMMARY

A system according to the principles of the present disclosure includes a valve control module and a fault detection module. The valve control module controls a valve actuator to actuate a valve of an engine from a first lift position to a second lift position that is different from the first lift position. The valve includes at least one of an intake valve and an exhaust valve. The fault detection module detects a fault in at least one of a valve lift sensor and the valve actuator based on input received from the valve lift sensor when the valve is adjusted to the first lift position and when the valve is adjusted to the second lift position.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A hydraulic valve actuator may include a main piston and a boost piston that is disposed concentric with the main piston. Pressurized fluid may act on the main piston and the boost piston, which in turn may engage and thereby lift an intake or exhaust valve. The boost piston provides additional surface area, and in turn additional force, to unseat the intake or exhaust valve. The main piston and the boost piston may cooperate to lift the intake or exhaust valve until the boost piston contacts a stop. Additional pressure may be required to cause the main piston to lift the intake or exhaust valve beyond the point at which the boost piston contacts the stop.

A valve actuator may include a valve lift sensor that detects valve lift. Typically, an engine control module determines the offset of the valve lift sensor based on input received from the valve lift sensor when the valve actuator is positioned to seat the intake or exhaust valve. In addition, the gain of the valve lift sensor is predetermined, for example, during assembly of the valve actuator. During engine operation, the engine control module determines valve lift based on input received from the valve lift sensor, the offset, and the gain.

An engine control system and method according to the principles of the present disclosure calibrates a valve lift sensor and/or evaluates a valve lift sensor and a valve actuator based on input from the valve lift sensor in two different valve lift positions. The offset of the valve lift sensor is determined when a valve actuator is in a first position to seat an intake or exhaust valve. The valve actuator is then adjusted to a second position in which a boost piston in the valve actuator contacts a stop. When the valve actuator is in the second position, input from the valve lift sensor may be used to determine the stroke of the boost piston based on a predetermined gain. Alternatively, the valve lift sensor input may be used to determine the gain of the valve lift sensor based on a predetermined boost piston stroke.

The boost piston stroke may be used to detect faults in the valve lift sensor and/or the valve actuator. For example, a fault may be detected when the boost piston stroke is outside of a predetermined range. The predetermined range may be established by measuring the boost piston stroke during assembly of the valve actuator.

Figure 1:
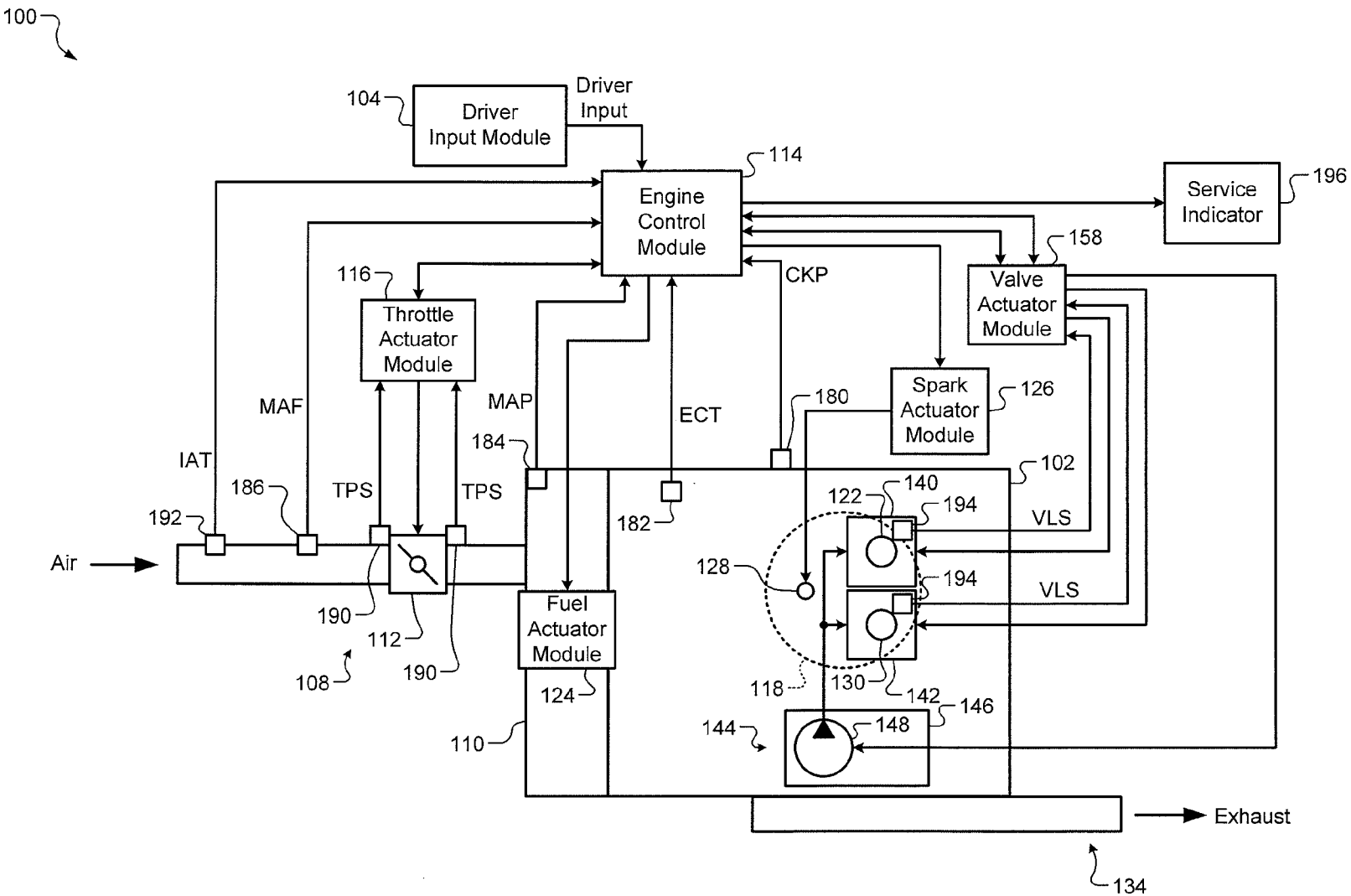
FIG. 1 is a functional block diagram of an example engine system according to the principles of the present disclosure.

Referring now to FIG. 1, a functional block diagram of an engine system 100 is presented. The engine system 100 includes an engine 102 that combusts an air/fuel mixture to produce drive torque for a vehicle based on driver input from a driver input module 104. Air is drawn into the engine 102 through an intake system 108. For example only, the intake system 108 may include an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders.

The engine 102 may operate using a four-stroke cycle. The four strokes, described below, are named the intake stroke, the compression stroke, the combustion stroke, and the exhaust stroke. During each revolution of a crankshaft (not shown), two of the four strokes within the cylinder 118 occur. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case a temperature increase in the cylinder 118 due to compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at or near its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the spark actuator module 126 may vary the spark timing relative to TDC by the same amount for all of the cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be actuated using an intake valve actuator 140, while the exhaust valve 130 may be actuated using an exhaust valve actuator 142. In various implementations, the intake valve actuator 140 may actuate multiple intake valves (including the intake valve 122) for the cylinder 118. Similarly, the exhaust valve actuator 142 may actuate multiple exhaust valves (including the exhaust valve 130) for the cylinder 118. Alternatively, a single valve actuator may actuate one or more exhaust valves for the cylinder 118 and one or more intake valves for the cylinder 118.

The intake valve actuator 140 and the exhaust valve actuator 142 actuate the intake valve 122 and the exhaust valve 130, respectively, independent from a camshaft. In this regard, the engine 102 may be camless, and the valve actuators 140, 142 may be hydraulic, pneumatic, or electromechanical. As presently shown, the valve actuators 140, 142 are hydraulic, and a hydraulic system 144 supplies pressurized fluid to the valve actuators 140, 142. The hydraulic system 144 includes an accumulator 146 and a pump 148 that sends fluid from the accumulator 146 to the valve actuators 140, 142.

A valve actuator module 158 may control the intake valve actuator 140 and the exhaust valve actuator 142 based on signals from the ECM 114. The valve actuator module 158 may control the intake valve actuator 140 to adjust the lift, duration, and/or timing of the intake valve 122. The valve actuator module 158 may control the exhaust valve actuator 142 to adjust the lift, duration, and/or timing of the exhaust valve 130. The valve actuator module 158 may control the pump 148 to adjust the pressure of fluid supplied to the valve actuators 140, 142.

The engine system 100 may measure the position of the crankshaft using a crankshaft position sensor (CKP) 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The valve actuator module 158 may monitor the lift of the intake valve 122 and the exhaust valve 130 using valve lift sensors (VLS) 194. The ECM 114 may use signals from the sensors to make control decisions for the engine system 100.

The ECM 114 calibrates the valve lift sensors 194 and/or detects faults in the valve lift sensors 194 and the valve actuators 140, 142 based on input received from the valve lift sensors 194 at two different valve lift positions. The ECM 114 may activate a service indicator 196 when a fault is detected in the valve lift sensors 194 and/or the valve actuators 140, 142. The service indicator 196 indicates that service is required using a visual message, an audible message, and/or a tactile message (e.g., vibration).

Figure 3:
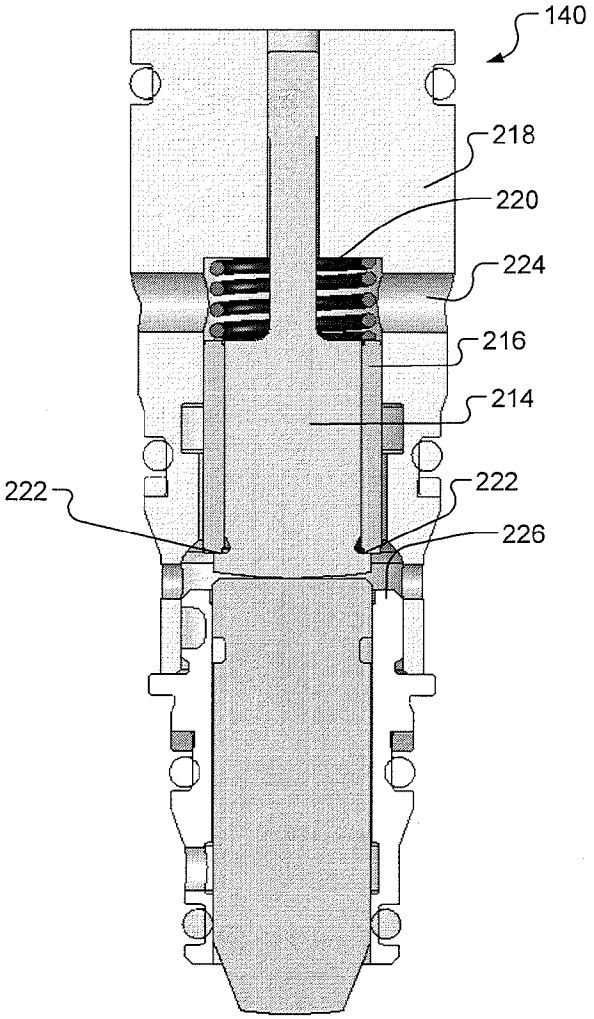
FIGS. 2 and 3 are section views of an example intake or exhaust valve and an example hydraulic valve actuator according to the principles of the present disclosure.
Figure 2:
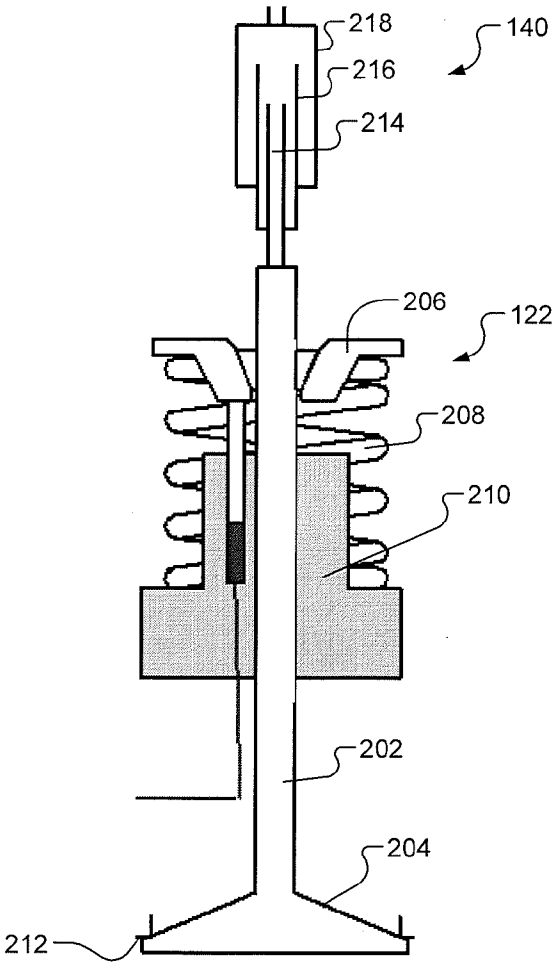

Referring now to FIGS. 2 and 3, for simplicity, example implementations of only the intake valve 122 and the intake valve actuator 140 are shown. However, the exhaust valve 130 may be identical to the intake valve 122, and the exhaust valve actuator 142 may be identical to the intake valve actuator 140. The intake valve 122 includes a valve stem 202, a tapered plug 204 fixed to one end of the valve stem 202, a spring seat 206 fixed to the valve stem 202 near its other end, and a valve spring 208 captured between the spring seat 206 and a valve guide 210. The valve spring 208 acts on the spring seat 206 to urge the tapered plug 204 against a valve seat 212.

The intake valve actuator 140 includes a main piston 214, a boost piston 216 disposed concentric with the main piston 214, an actuator body 218, and an actuator spring 220 captured between the boost piston 216 and the actuator body 218. The actuator spring 220 maintains the boost piston 216 in contact with flanges 222 on the main piston 214. The actuator body 218 includes a passage 224 and a piston stop 226. Pressurized fluid flows through the passage 224 and acts on the main piston 214 and the boost piston 216 and to counteract the force of the valve spring 208 and thereby unseat the intake valve 122. The main piston 214 and the boost piston 216 cooperate to lift the intake valve 122 until the boost piston 216 contacts the piston stop 226.

Figure 4:
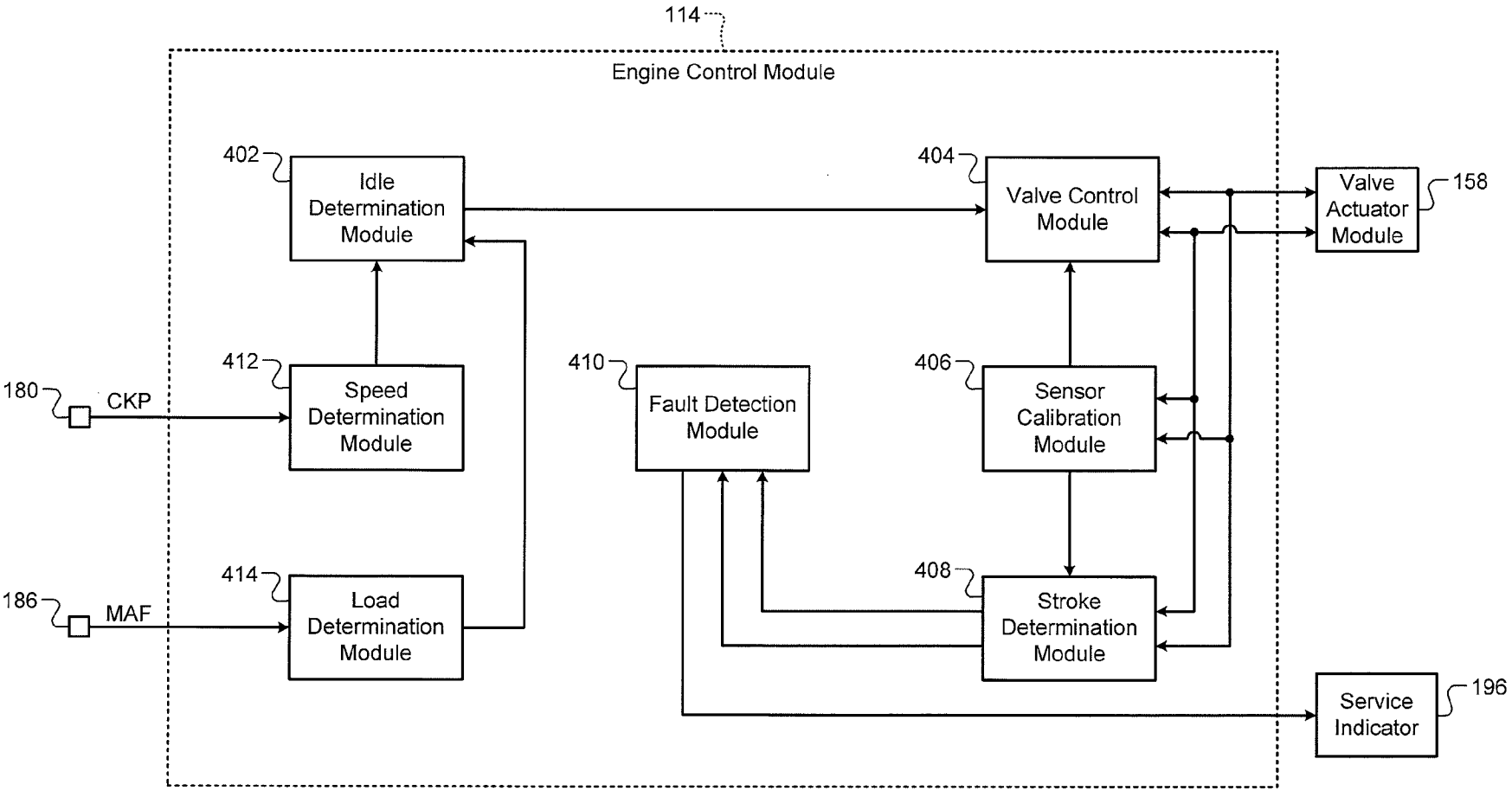
FIG. 4 is a functional block diagram of an example engine control system according to the principles of the present disclosure.

Referring now to FIG. 4, an example implementation of the ECM 114 includes an idle determination module 402, a valve control module 404, a sensor calibration module 406, a stroke determination module 408, and a fault detection module 410. For simplicity, the discussion below describes the ECM 114 as detecting faults in the intake valve actuator 140 and/or the one of the valve lift sensors 194 that measures lift of the intake valve 122, as well as calibrating the one of the valve lift sensors 194. However, in a similar manner, the ECM 114 may detect faults in the exhaust valve actuator 142 and/or the one of the valve lift sensors 194 that measures lift of the exhaust valve 130, as well as calibrate the one of the valve lift sensors 194.

The idle determination module 402 determines whether the engine 102 is idling. When the engine 102 is idling, the pressure within the cylinder 118 may be approximately zero. Thus, the intake valve actuator 140 may only need to overcome the force of the valve spring 208 in order to lift the intake valve 122. The idle determination module 402 may determine that the engine 102 is idling when the speed of the engine 102 is less than a predetermined speed and the load on the engine 102 is less than a predetermined load. The idle determination module 402 outputs a signal indicating whether the engine 102 is idling.

A speed determination module 412 determines the engine speed based on, for example, input received from the crankshaft position sensor 180. A load determination module 414 determines the engine load based on, for example, input received from the mass air flow sensor 186. The speed determination module 412 and the load determination module 414 output the engine speed and the engine load, respectively.

The valve control module 404 instructs the valve actuator module 158 to actuate the intake valve 122 from a first lift position to a second lift position when the engine 102 is idling. The first lift position may correspond to zero lift. The second lift position may be the position of the intake valve 122 when the boost piston 216 contacts the piston stop 226 (FIG. 3).

The valve control module 404 may instruct the valve actuator module 158 to actuate the intake valve 122 from the first lift position to the second lift position by adjusting the pressure of fluid supplied to the intake valve actuator 140 to a first pressure. The valve actuator module 158 may adjust the supply pressure by controlling the pump 148. The first pressure may be greater than a second pressure that causes the intake valve actuator 140 to unseat the intake valve 122. The first pressure may be less than a third pressure that causes the main piston 214 to lift the intake valve 122 beyond the point at which the boost piston 216 contacts the piston stop 226 (FIG. 3).

Additionally, the valve control module 404 may instruct the valve actuator module 158 to actuate the intake valve 122 from the first lift position to the second lift position by adjusting a flow control valve (not shown). The flow control valve may be disposed in the intake valve actuator 140 upstream from the passage 224 in the actuator body 218 (FIG. 3). The valve control module 404 may instruct the valve actuator module 158 to adjust the flow control valve to a position that corresponds to maximum lift or another degree of valve lift that is greater than the stroke of the boost piston 216. However, the lift of the intake valve 122 may be limited to the stroke of the boost piston 216 due to the pressure of the hydraulic fluid supplied to the intake valve actuator 140.

The sensor calibration module 406 calibrates the valve lift sensor 194. The sensor calibration module 406 may calibrate the valve lift sensor 194 by determining the offset of the valve lift sensor 194. The sensor calibration module 406 may determine the offset of the valve lift sensor 194 based on input received from the valve lift sensor 194 when the intake valve 122 is adjusted to the first lift position.

The sensor calibration module 406 may also calibrate the valve lift sensor 194 by determining the gain of the valve lift sensor 194. The sensor calibration module 406 may determine the gain of the valve lift sensor 194 based on input received from the valve lift sensor 194 when the intake valve 122 is adjusted to the second lift position. The sensor calibration module 406 may determine a difference between valve lift sensor input received when the intake valve 122 is adjusted to the first lift position and valve lift sensor input received when the intake valve 122 is adjust to the second lift position. The sensor calibration module 406 may determine the gain of the valve lift sensor 194 by dividing this difference by the stroke of the boost piston 216 (FIG. 3). The stroke of the boost piston 216 may be predetermined, for example, by measuring the stroke using a measuring instrument (e.g., caliper) during assembly of the intake valve actuator 140.

The sensor calibration module 406 outputs the offset and/or the gain of the valve lift sensor 194. The valve control module 404 may measure valve lift based on the offset and/or the gain, and may control lift of the intake valve 122 using the measured valve lift as closed-loop feedback. For example, the valve control module 404 may measure the valve lift by subtracting the offset from the valve lift sensor input and multiplying the resulting difference by the gain. The gain may be predetermined or determined as described above with reference to the sensor calibration module 406.

The stroke determination module 408 determines the stroke of the boost piston 216 based on the measured valve lift. The stroke determination module 408 may determine the measured valve lift in the manner described above with reference to the valve control module 404. Alternatively, the stroke determination module 408 may receive the measured valve lift from the valve control module 404.

A first valve lift may be measured when the intake valve 122 is adjusted to the first lift position. A second valve lift may be measured when the intake valve 122 is adjusted to a second lift position. The stroke determination module 408 may determine the stroke of the boost piston 216 based on the difference between the first valve lift and the second valve lift. The stroke determination module 408 outputs the stroke of the boost piston 216.

The fault detection module 410 detects a fault in the intake valve actuator 140 and/or the valve lift sensor 194 when the stroke of the boost piston 216 is outside of a predetermined range. The stroke of the boost piston 216 may be measured during assembly of the intake valve actuator 140 as discussed above, and the predetermined range may be a function of the measured stroke. For example, the measured stroke may be 2.2 millimeters (mm), and the predetermined range may be 2.2+/−0.2 mm.

The fault detection module 410 may activate the service indicator 196 when a fault is detected in the intake valve actuator 140 and/or the valve lift sensor 194. Various diagnostics may be performed to determine whether the fault is due to valve lift sensor issues (e.g., drift) or boost piston motion problems (e.g., wear, stuck). For example, the intake valve actuator 140 and/or the valve lift sensor 194 may be physically inspected and/or replaced.

Figure 5:
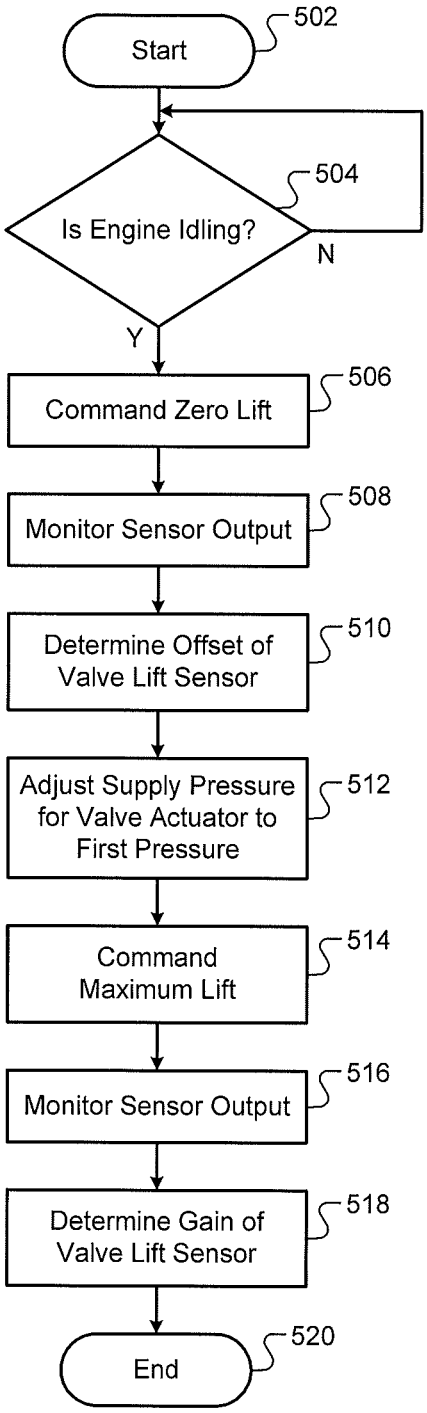
FIGS. 5 and 6 are flowcharts illustrating example engine control methods according to the principles of the present disclosure.

Referring now to FIG. 5, a method for calibrating a valve lift sensor begins at 502. The valve lift sensor measures lift of an intake or exhaust valve of an engine. At 504, the method determines whether the engine is idling. The method may determine that the engine is idling when the speed of the engine is less than a predetermined speed and the load on the engine is less than a predetermined load. If the engine is idling, the method continues at 506. Otherwise, the method remains at 504.

At 506, the method commands a valve actuator to actuate the intake or exhaust valve to a first lift position that corresponds to zero lift. At 508, the method monitors the output of the valve lift sensor. At 510, the method determines the offset of the valve lift sensor. The offset of the valve lift sensor may be equal to the output of the valve lift sensor when the intake or exhaust valve is adjusted to the first lift position.

At 512, the method adjusts the pressure of hydraulic fluid supplied to the valve actuator to a first pressure. The method may adjust the hydraulic fluid pressure by controlling a pump that supplies the hydraulic fluid to the valve actuator. The valve actuator may include a main piston and a boost piston that is disposed concentric with the main piston. The main piston and the boost piston may cooperate to unseat the intake or exhaust valve when the hydraulic fluid pressure is equal to a second pressure. The main piston may lift the intake or exhaust valve beyond the point at which the boost piston contacts a piston stop in the valve actuator when the hydraulic fluid pressure is equal to a third pressure. The first pressure may be greater than the second pressure and less than the third pressure.

At 514, the method commands the valve actuator to actuate the intake or exhaust valve to a second lift position. The second lift position may correspond to maximum lift or another degree of valve lift that is greater than the stroke of the boost piston. However, the lift of the intake or exhaust valve may be limited to the stroke of the boost piston due to the pressure of the hydraulic fluid supplied to the valve actuator. In other words, the pressure of hydraulic fluid supplied to the valve actuator, which is adjusted to the first pressure, may yield enough force when acting on the main piston and the boost piston to lift the intake or exhaust valve through the boost piston stroke. However, the first pressure may not yield enough force when acting on the main piston but not the boost piston, which is stopped from further movement, to lift the intake or exhaust valve beyond the boost piston stroke.

At 516, the method monitors the output of the valve lift sensor. At 518, the method determines the gain of the valve lift sensor. The method may determine the gain by determining the difference between the output measured at 508 and the output measured at 516, and dividing this difference by the stroke of the boost piston. The stroke of the boost piston may be predetermined. The method ends at 520.

Figure 6:
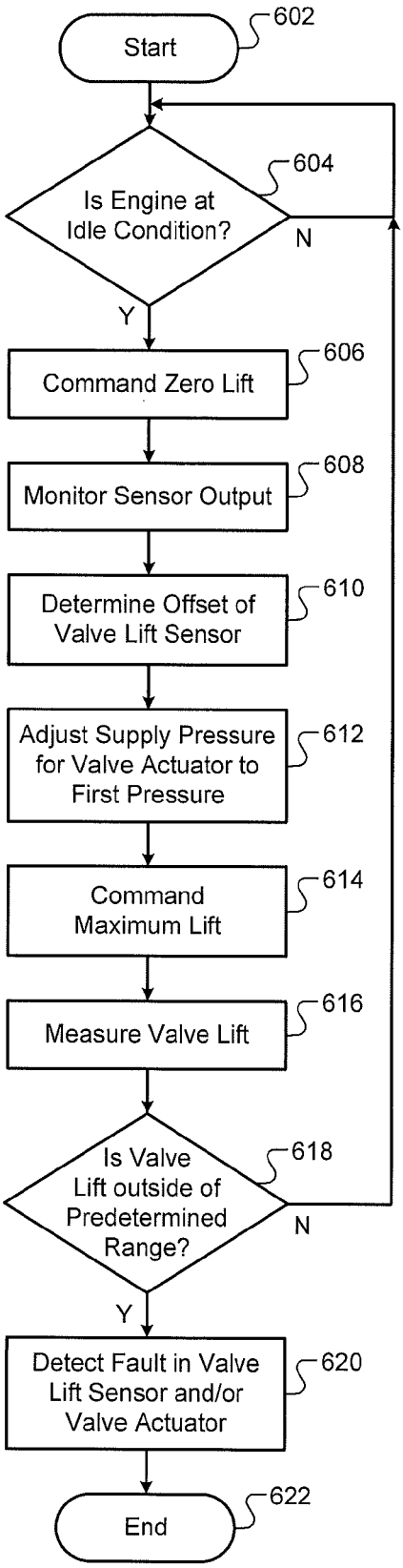

Referring now to FIG. 6, a method for detecting a fault in a valve lift sensor and/or a valve actuator begins at 602. At 604, the method determines whether an engine is idling. The method may determine that the engine is idling when the speed of the engine is less than a predetermined speed and the load on the engine is less than a predetermined load. If the engine is idling, the method continues at 606. Otherwise, the method remains at 604.

At 606, the method commands the valve actuator to actuate an intake or exhaust valve to a first lift position that corresponds to zero lift. At 608, the method monitors the output of the valve lift sensor. At 610, the method determines the offset of the valve lift sensor. The offset of the valve lift sensor may be equal to the output of the valve lift sensor when the intake or exhaust valve is adjusted to the first lift position.

At 612, the method adjusts the pressure of hydraulic fluid supplied to the valve actuator to a first pressure. The method may adjust the hydraulic fluid pressure by controlling a pump that supplies the hydraulic fluid to the valve actuator. The valve actuator may include a main piston and a boost piston that is disposed concentric with the main piston. The main piston and the boost piston may cooperate to unseat the intake or exhaust valve when the hydraulic fluid pressure is equal to a second pressure. The main piston may lift the intake or exhaust valve beyond the point at which the boost piston contacts a piston stop in the valve actuator when the hydraulic fluid pressure is equal to a third pressure. The first pressure may be greater than the second pressure and less than the third pressure.

At 614, the method commands the valve actuator to actuate the intake or exhaust valve to a second lift position. The second lift position may correspond to maximum lift or another degree of valve lift that is greater than the stroke of the boost piston. However, the lift of the intake or exhaust valve may be limited to the stroke of the boost piston due to the pressure of the hydraulic fluid supplied to the valve actuator.

At 616, the method measures the lift of the intake or exhaust valve. Since the valve lift may be limited by the hydraulic fluid pressure, the measured valve lift may be equal to the stroke of the boost piston. The method may measure the lift of the intake or exhaust valve using the offset and the gain of the valve lift sensor. For example, the method may measure the measure valve lift by subtracting the offset from the output of the valve lift sensor when the intake or exhaust valve is adjusted to the second lift position, and multiplying the resulting difference by the gain. The gain may be predetermined, for example, during assembly of the valve actuator in a temperature-controlled environment. Alternatively, the gain may be determined as described above with reference to 518 of FIG. 5.

At 618, the method determines whether the measured valve lift is outside of a predetermined range. If the measured valve lift is outside of the predetermined range, the method continues at 620 and detects a fault in the valve lift sensor and/or the valve actuator. Otherwise, the method continues at 604. The method ends at 622.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a valve control module that controls a valve actuator to actuate a valve of an engine from a first lift position to a second lift position that is different from the first lift position, wherein the valve includes at least one of an intake valve and an exhaust valve; and a fault detection module that detects a fault in at least one of a valve lift sensor and the valve actuator based on input received from the valve lift sensor when the valve is adjusted to the first lift position and when the valve is adjusted to the second lift position.

2. The system of claim 1, wherein the valve control module adjusts the valve from the first lift position to the second lift position when engine speed is less than a predetermined speed and engine load is less than a predetermined load.

3. The system of claim 1, further comprising a sensor calibration module that calibrates the valve lift sensor based on the input received from the valve lift sensor.

4. The system of claim 3, wherein the sensor calibration module calibrates the valve lift sensor by determining at least one of an offset and a gain of the valve lift sensor.

5. The system of claim 1, wherein the valve control module adjusts the valve from the first lift position to the second lift position by adjusting pressure of hydraulic fluid supplied to the valve actuator to a first pressure.

6. The system of claim 5, wherein the first pressure is greater than a second pressure that causes the valve actuator to unseat the valve.

7. The system of claim 6, wherein the valve actuator includes a first piston and a second piston that cooperate to unseat the valve when the pressure of the hydraulic fluid is equal to the second pressure.

8. The system of claim 7, wherein the first pressure is less than a third pressure that causes the first piston to lift the valve by an amount that is greater than a stroke of the second piston.

9. The system of claim 8, further comprising a stroke determination module that determines the stroke of the second piston based on the input received from the valve lift sensor.

10. The system of claim 9, wherein the fault detection module detects the fault in the at least one of the valve lift sensor and the valve actuator when the stroke of the second piston is outside of a predetermined range.

11. A method comprising:

controlling a valve actuator to actuate a valve of an engine from a first lift position to a second lift position that is different from the first lift position, wherein the valve includes at least one of an intake valve and an exhaust valve; and detecting a fault in at least one of a valve lift sensor and the valve actuator based on input received from the valve lift sensor when the valve is adjusted to the first lift position and when the valve is adjusted to the second lift position.

12. The method of claim 11, further comprising adjusting the valve from the first lift position to the second lift position when engine speed is less than a predetermined speed and engine load is less than a predetermined load.

13. The method of claim 11, further comprising calibrating the valve lift sensor based on the input received from the valve lift sensor.

14. The method of claim 13, further comprising calibrating the valve lift sensor by determining at least one of an offset and a gain of the valve lift sensor.

15. The method of claim 11, further comprising adjusting the valve from the first lift position to the second lift position by adjusting pressure of hydraulic fluid supplied to the valve actuator to a first pressure.

16. The method of claim 15, wherein the first pressure is greater than a second pressure that causes the valve actuator to unseat the valve.

17. The method of claim 16, wherein the valve actuator includes a first piston and a second piston that cooperate to unseat the valve when the pressure of the hydraulic fluid is equal to the second pressure.

18. The method of claim 17, wherein the first pressure is less than a third pressure that causes the first piston to lift the valve by an amount that is greater than a stroke of the second piston.

19. The method of claim 18, further comprising determining the stroke of the second piston based on the input received from the valve lift sensor.

20. The method of claim 19, further comprising detecting the fault in the at least one of the valve lift sensor and the valve actuator when the stroke of the second piston is outside of a predetermined range.

21. The system of claim 1, wherein the fault detection module detects the fault in the at least one of the valve lift sensor and the valve actuator based on a difference between the input received from the valve lift sensor when the valve is adjusted to the first lift position and the input received from the valve lift sensor when the valve is adjusted to the second lift position.

22. The method of claim 11, further comprising detecting the fault in the at least one of the valve lift sensor and the valve actuator based on a difference between the input received from the valve lift sensor when the valve is adjusted to the first lift position and the input received from the valve lift sensor when the valve is adjusted to the second lift position.

* * * * *